US006039423A

United States Patent [19]

Fulterer

[11] Patent Number: 6,039,423

[45] Date of Patent: Mar. 21, 2000

[54] PULL-OUT DEVICE FOR A TALL CUPBOARD

[75] Inventor: Manfred Fulterer, Lustenau, Austria

[73] Assignee: Fulterer Gesellschaft m.b.H., Lustenau, Austria

[21] Appl. No.: 09/145,394

[22] Filed: Sep. 1, 1998

[30] Foreign Application Priority Data

Sep. 3, 1997 [AT] Austria ..... 1474/97
Dec. 30, 1997 [AT] Austria ..... 2199/97

[51] Int. Cl.[7] ..... A47B 88/00

[52] U.S. Cl. ..... 312/334.29; 312/334.33

[58] Field of Search ..... 312/334.27, 334.29, 312/334.31, 334.32, 334.33, 334.34, 334.39, 334.6

[56] References Cited

U.S. PATENT DOCUMENTS 5,902,029 5/1999 Fulterer ..... 312/334.29

FOREIGN PATENT DOCUMENTS 0285099 10/1970 Australia .
1532775 6/1968 France .

OTHER PUBLICATIONS

Prospect FR 716 "Differential Pull–out of a Tall Cupboard" Fulterer Sep. 1995.
Prospect Slide–out Cupboard System Peka Metall AG 1.2; 1.2.1; 1.2.2; 1.2.3.; 1.2.4; 1.2.5; 1.7.
Prospect "Complete Pull–out of a Tall Cupboard" Dispensa 9.32.

*Primary Examiner*—Anthony Knight
*Assistant Examiner*—Karlena D. Schwing
*Attorney, Agent, or Firm*—Brown & Wood, LLP

[57] ABSTRACT

A pull-out device for a tall cupboard including a U-shaped carcass rail having opposite cheeks provided at their upper edges with inwardly bent flanges which serve as running tracks an intermediate rail received in the carcass rail and having a plurality of support and running rollers having their axles lying in different horizontal planes, with a support roller being provided in an upper rear portion of each cheek of the intermediate rail and displaceable along the running track defined by a respective flange of the carcass rail, and with at least one running roller being provided in a middle region of a longitudinal extent of each cheek of the intermediate rail and supported with a radial clearance, and a pull-out rail having opposite horizontal flanges supported by the running rollers, with the running tracks-forming flanges of the carcass rail being inclined, from a rear end of the carcass rail, at least along a portion of their longitudinal extend, toward a front end of the carcass rail.

6 Claims, 6 Drawing Sheets

1
2
3
4
5
6
7
8
9
10
11
12
13
14
15
H

PULL-OUT DEVICE FOR A TALL CUPBOARD

BACKGROUND OF THE INVENTION

1. Field of the Invention

The present invention relates to a pull-out device for a tall cupboard including a U-shaped carcass rail having opposite cheeks provided at their upper edges with inwardly bent flanges which serve as running tracks, an intermediate rail received in the carcass rail and having a plurality of support and running rollers having their axles lying in different horizontal planes, with a support roller being provided in an upper rear portion of each cheek of the intermediate rail and displaceable along the running track defined by a respective flange of the carcass rail, and with at least one running roller being provided in a middle region of a longitudinal extent of each cheek of the intermediate rail and supported with a radial clearance, and a pull-out rail having opposite horizontal flanges supported by the running rollers of the intermediate rail.

2. Description of the Prior Art

Different embodiments of pull-out devices of the above-described type are disclosed in Austrian Patent No. 285,099, prospects "Differential Pull-Out of a Tall Cupboard"—Fulterer 09/95, prospect of the firm "Peka Metall AG", prospect "Complete Pull-out of a Tall cupboard" Dispensa 9/35 and the like. The carrying-on weight of such pull-out devices is often rather large and can reach 1,500 N. As a result of carrying of a large weight, the pull-out rails in their pull-out condition become somewhat deformed which results, in inclination, with respect to a vertical, of front trim of tall cup-boards which are connected with the pull-out rails. This deformation of the pull-out rails can be reduced by increasing the dimensions of the rails and rollers. However, this leads to an increase of overall dimensions of the pull-out devices and their weight. In this connection, there were contemplated suspended pull-out devices for tall cupboards such as, e.g., disclosed in French patent No. 1,532,775, which are buckled along a portion of their length. However, this construction did not prove itself.

Accordingly, an object of the present invention is to prevent or substantially reduce the deformation of a pull-out rail, without increasing noticeably the dimensions and weight of the pull-out device.

SUMMARY OF THE INVENTION

This and other objects of the present invention, which will become apparent hereinafter, are achieved by inclining the running track-forming flanges of the carcass rail, at least along a portion of their longitudinal extent, from the rear end of the carcass rail toward the front end of the rail. At that, the inclination angle is rather small. The invention permits to use conventional rails having a conventional thickness and design. These rails do become deformed under a load applied thereto. However, a possible inclination of the front trim of the tall cupboard is compensated by the inclination of the rails due to the inclination of the running track-forming flanges of the carcass rail. The deformation of the pull-out rails under a load provides for a vertical position of the front trim.

BRIEF DESCRIPTION OF THE DRAWINGS

The features and objects of the present invention will become more apparent, and the invention itself will be best understood from the following detailed description for the preferred embodiments when read with reference to the accompanying drawings, wherein.

DETAILED DESCRIPTION OF THE PREFERRED EMBODIMENTS

Figures 1, 2, 3, 4, 5, 6:
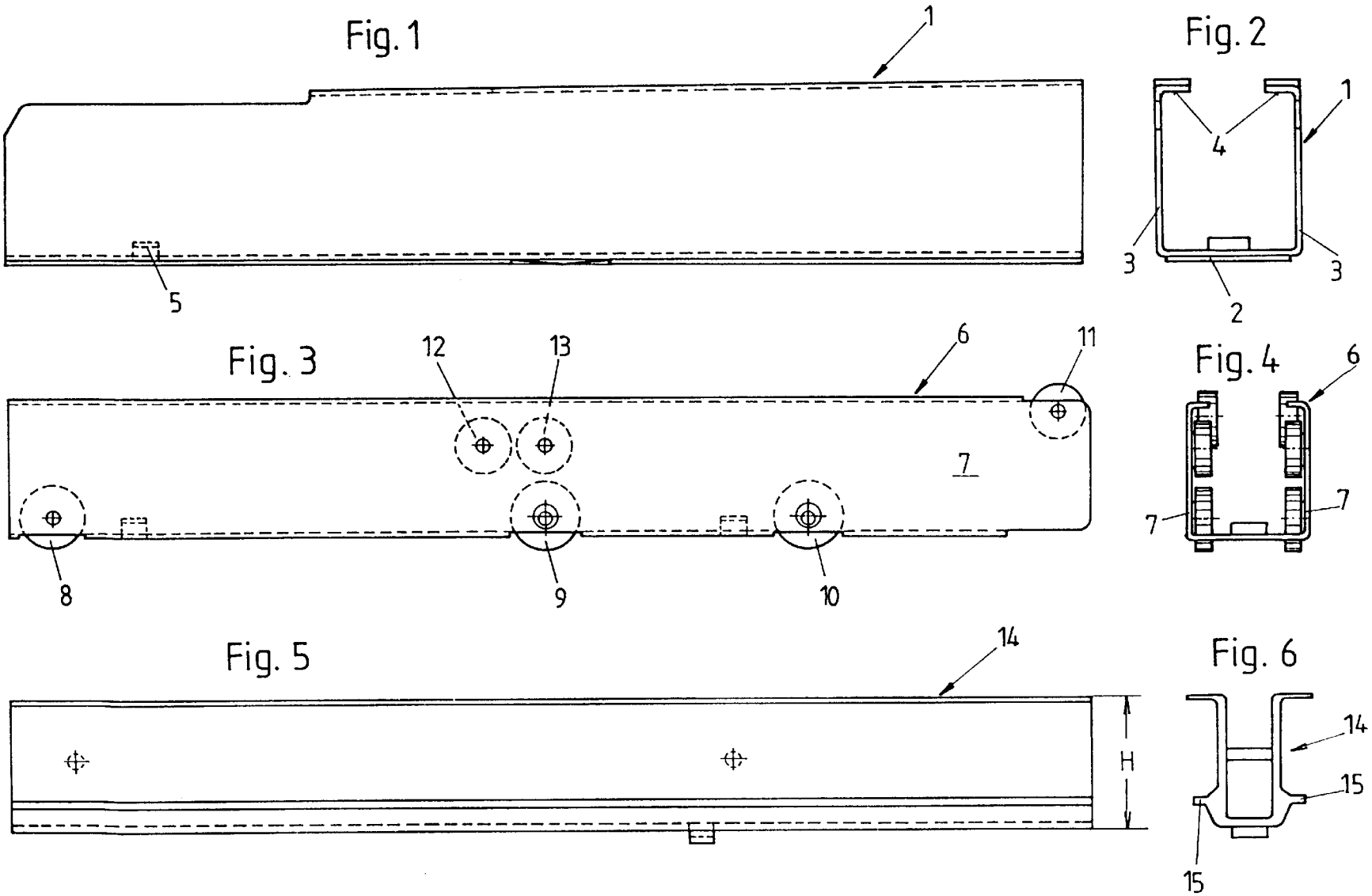
FIG. 1 shows a side view of the carcass rail of a first embodiment of a pull-out device according to the present invention.
FIG. 2 shows an end view of the carcass rail shown in FIG. 1.
FIG. 3 shows a side view of the intermediate rail of the first embodiment of a pull-out device according to the present invention.
FIG. 4 shows an end view of the intermediate rail shown in FIG. 3.
FIG. 5 shows a side view of the pull-out rail of the first embodiment of a pull-out device according to the present invention.
FIG. 6 shows an end view of the pull-out rail shown in FIG. 5.

FIGS. 1–9 show a first embodiment of a pull-out device for a tall cupboard according to the present invention, and FIGS. 10–17 show a second embodiment of the inventive pull-out device. In both embodiment, the same elements will be designated with the same reference numerals.

The pull-out device shown in FIGS. 1–9 includes a carcass rail 1 having a U-shaped cross-section with two side cheeks 3 connected by a web 2. In the front region of the carcass rail 1, there is provided a stop 5. Upper edges of the side cheeks 3 are bent inwardly, forming facing each other flanges 4. The flanges 4 are somewhat inclined from the rear end of the carcass rail 1 toward the front end of the carcass rail 1. This inclination is very small, e.g., it may amount to 3 mm for a rail length of 500 mm. This inclination changes with a change of the length of the pull-out device and a change of the nominal load contemplated for this device. In the embodiment shown in the drawings, the flanges 4 are inclined over their entire length. However, these flanges 4 can be inclined only in their respective rear portions. The inclination of the flanges 4 is seen in relation to the horizontal, rectilinear web 2 which connects the side cheeks 3.

An intermediate rail 6 likewise has a U-shaped cross-section and has the upper edges of its side cheeks bent inwardly and forming facing each other flanges. On respective inner sides of the side cheeks 7, there are provided freely rotatable rollers. Of these freely rotatable rollers, two running rollers 9 are supported with a radial clearance, and third support roller 11 is arranged at the rear end of the intermediate rail 6 and projects slightly above the upper edge of the intermediate rail 6. In the middle region of the intermediate rail 6 above the running roller 9, there are provided two support rollers 12 and 13 arranged adjacent to each other. Further, a running roller 8 is provided at the front end of the intermediate rail 6.

A pull-out rail 14 also has a U-shaped cross-section and is provided, at the one third of its height H, from the connecting web, with two sidewise projecting flanges 15.

Figure 7:
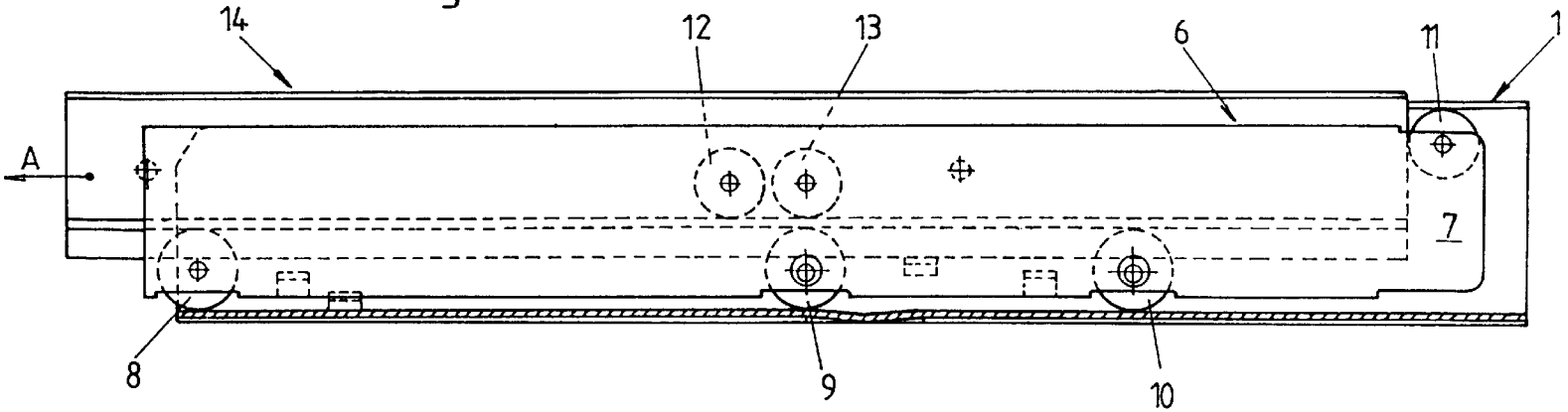
FIG. 7 shows a side view of the first embodiment of a pull-out device according to the present invention in a partially extended condition.
Figure 8:
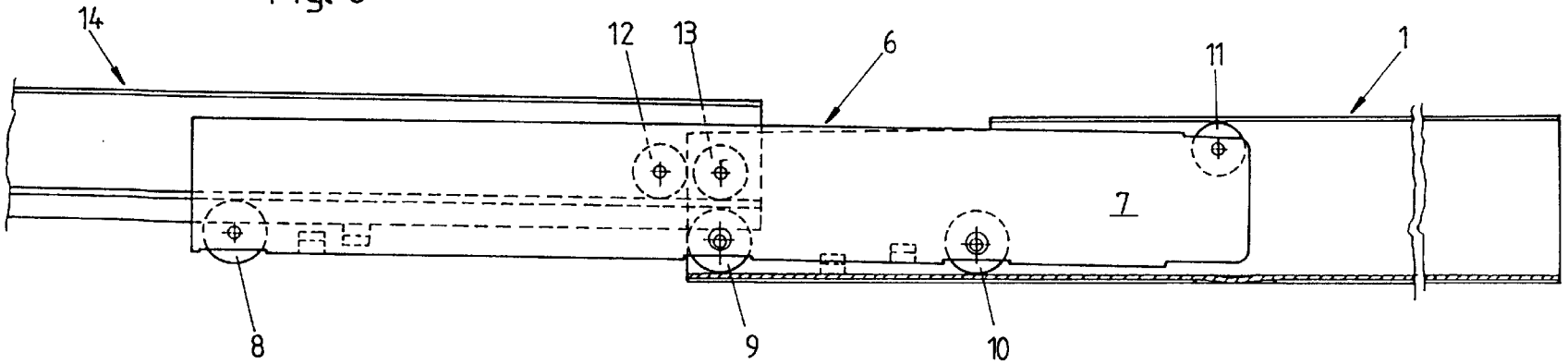
FIG. 8 shows a side view of the pull-out device of FIG. 7 in completely extended condition.
Figure 9:
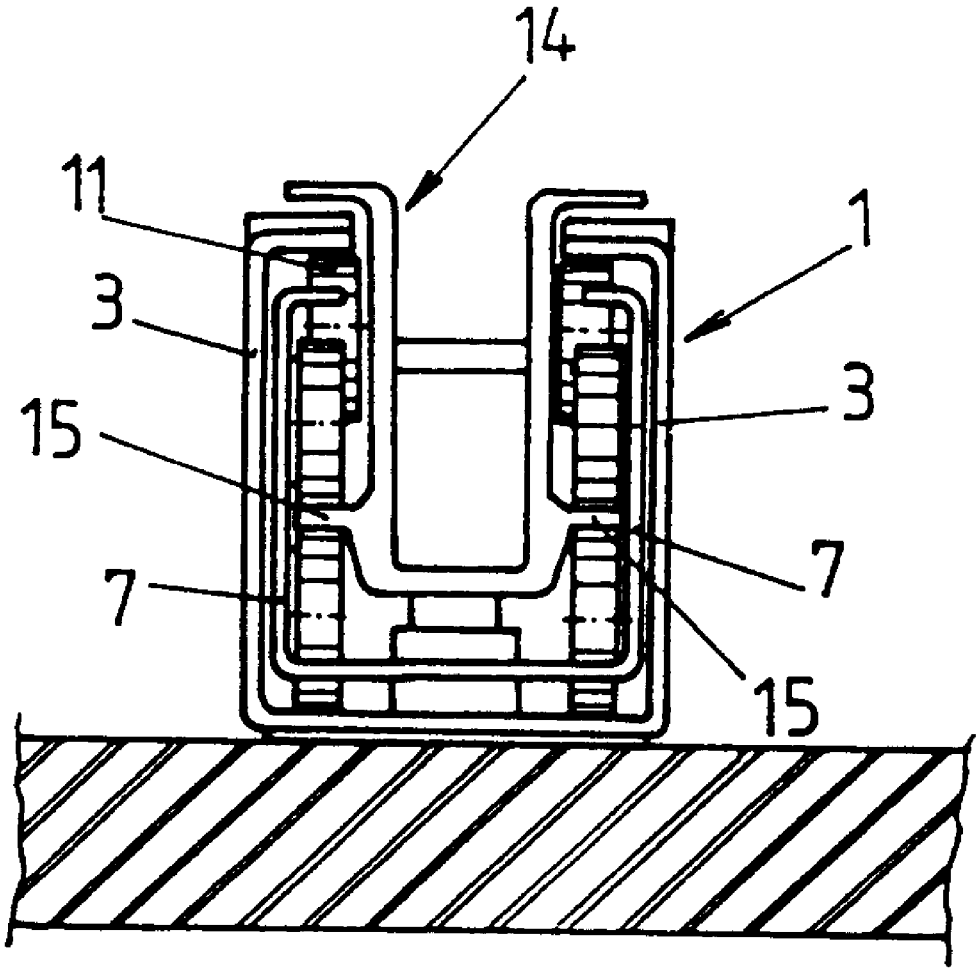
FIG. 9 shows an end view of the pull-out device shown in FIG. 7.

The assembly formed of the carcass rail 1, the intermediate rail 6, and the pull-out 14 is shown in FIG. 7. In FIG. 7, the front side cheek 3 of the carcass rail 1 is removed and is cut-off. The running rollers 8, 9, 10 of the intermediate rail are supported on the web 2 of the carcass roller 1. These running rollers 8, 9, 10 support the flanges 15 of the pull-out rail 14. The flanges 15 are retained in engagement with the running rollers 8, 9, 10 by the support rollers 12-13. The rear rollers 14 engage the lower surfaces of the flanges 4 of the carcass rail 1.

The pull-out device shown in FIGS. 1–7 is formed as a differential pull-out device. When the pull-out rail 14 is pulled-out (in the direction of arrow A), the intermediate rail 6 is pulled out with it because the rollers 9–13 engage the flanges 15 of the pull-out rail 14 which, upon being pulled out, entrain the rollers 9–13, together with the intermediate rail 6. With such pulling-out of the pull-out and intermediate rails, the support roller 11 is displaced in a channel formed in the web 2 and the flange 4 of the carcass rail 1. This channel narrows toward the front of the carcass rail 1, i.e., in the pull-out direction. This channel narrows by amount of the above-described inclination. As a result of this, only the rear end of the moving forward intermediate rail 6 is pressed somewhat downward, and the portion of the intermediate rail 6 in front of the roller 9, which supports the pull-out rail 14, is slightly lifted. The weight of a tall cupboard, which is secured on the pull-out rail 14, compensates the lift of the front portion of the intermediate rail 6 so that the front trim of the cupboard (not shown) extends vertically. In the pulled-out condition (shown in FIG. 7) all rails extend parallel to each other.

The carcass rail 1 of the pull-out device shown in FIGS. 10–17 also has a U-shaped cross-section with two side cheeks 3 connected by a web 3. In the front region of the carcass rail 1, there is provided a stop 5. Upper edges of the side cheeks 3 are bent inwardly, forming facing each other flanges 4. The outer longitudinal edges of the carcass rail 1 extend parallel to each other. The flanges 4 are deformed by stamping along a half of their length from the rear end of the carcass rail 1, so that they are inclined toward the front end of the carcass rail 1, with the inclination forming only a very small angle with a horizontal. This inclination is very small, e.g., it may amount to from 1,5 to 2 mm for a rail length of 500 mm. This inclination changes with a change of the length of the pull-out device and a change of the nominal load contemplated for this device. The deformation of the flanges is so effected that the inclinations remain integral with the side cheeks of the carcass rail 1, which insures a necessary stability and rigidity of the intermediate rail 6. The inclination of the flanges 4 is seen in relation to the horizontal, linear web 2 which connects the cheeks 3.

The intermediate rail 6 is formed of two Z-shaped sections 16 connected by a web 17. On the facing each other side surfaces of the two z-shaped section 16, there are provided free by rotatable rollers. Of those freely rotatable rollers, two running rollers 9 are supported with a radial clearance, and the third support roller 11 is arranged at the rear end of the intermediate rail 6. The support rollers 11 are arranged on outer side surfaces of respective Z-shaped sections 16. In the middle region of the intermediate rail 6 above the running roller 9, there is provided a support roller 12. Further, a running roller 8 is provided at the front end of the intermediate rail 6.

The pull-out rail 14 is also formed of two shaped rails 18 connected by a web 19. The pull-out rail 14 carries two sidewise projecting flanges 15. The pull-out rail 14 has no support and running rollers, but has, in its middle region, a downwardly projecting stop 20. Lower horizontal legs of a frame 21 of the tall cupboard are secured in the space between the two shaped rails 18. The tall cupboard frame supports different elements (not shown).

Figure 16A:
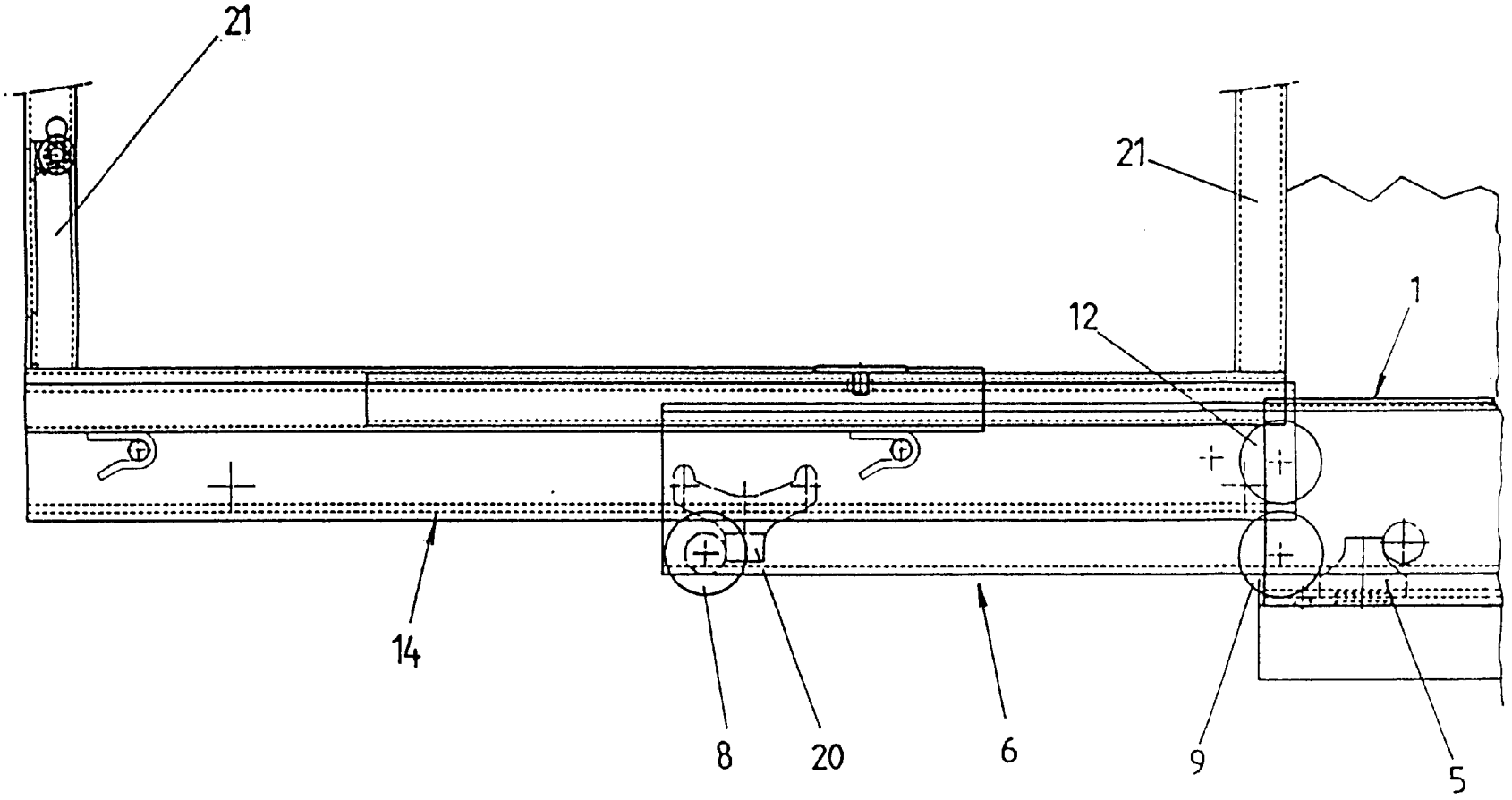
FIG. 16*a* shows a partial side view of the front portion of the second embodiment of the pull-out device according to the present invention in an extended condition.
Figure 16B:
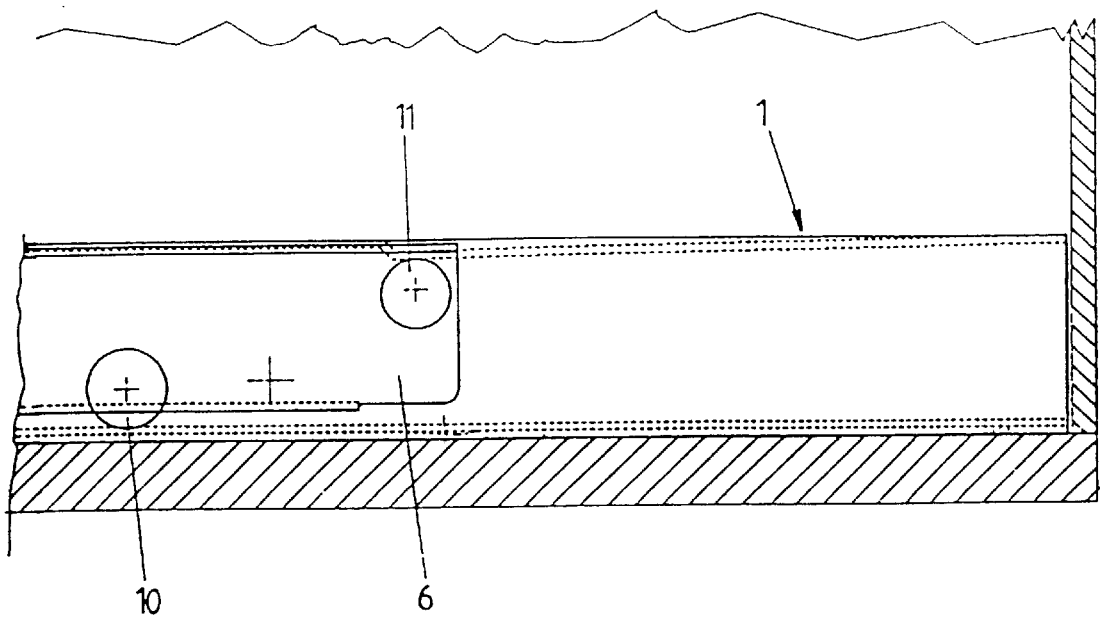
FIG. 16*b* shows a partial side view of the rear portion of the pull-out device according to the present invention in an extended condition.
Figure 17:
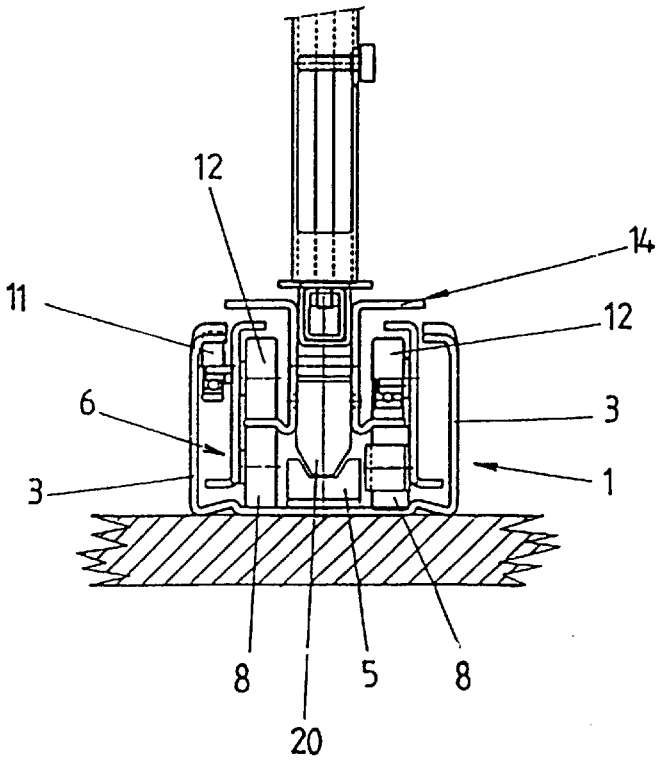
FIG. 17 shows an end view of the pull-out device shown in FIGS. 16*a*–16*b*.

The rail assembly is shown in FIGS. 16*a*–16*b*. The running rollers 9, 10 of the intermediate rail 6 arc are supported on a web 2 of the carcass rail 1. The front running roller 8 of the intermediate rail 6 overruns the carcass rail 1 and cooperates with the stop 20 of the pull-out rail 14 which limits the pull-out length. The running rollers 8, 9, 10 support the flanges 15 of the pull-out rail. The flanges are retained in engagement with the rollers 8, 9, 10 by the support rollers 12. The rear support rollers 11 engage the lower surfaces of the flanges 4 of the carcass rail 1 which form the running tracks.

The pull-out device shown in FIGS. 10–17 is also formed as a differential pull-out device. Upon the pull-out rail 14 being pulled, the intermediate rail 6 is displaced with it because the rollers 9, 10 and 12 are clampingly connected or clampingly engage the sidewise projecting flanges 15 of the pull-out rail 14 and are entrained by the flanges 15 when the pull-out rail 14 is actually pulled out. With this pulling of the rails, only the support rollers 11 of the intermediate rail 6 roll along the flanges 4 which serve as running tracks. Because only the rear end of the moving forward intermediate rail 6 is pressed somewhat downward, and the portion of the intermediate rail 6, which supports the pull-out rail 14 is slightly lifted. The weigh of a tall cupboard elements (not shown), which are secured on the pull-out rail 14, compensate the lift of the front portion of the intermediate rail 6 so that the front trim of the cupboard (not shown) or the legs of the cupboard frame extend vertically. In the pulled-out condition (shown in FIG. 7) all rails extend parallel to each other.

The present invention permits to form the carcass rail 1 in a conventional manner from a rectilinear sheet metal material by bending it to a desired U-shape. The so-formed U-shaped section of the carcass rail 1 is then processed on stamping press in which the flange 4 is deformed along a half of its length, so that an inclined running track is formed for the support roller 11 of the intermediate rail 6. The inclined portion of the flange 4 despite its deformation, remains integral with the respective side cheek 3 of the carcass rail, insuring the necessary stability and rigidity of the carcass rail 1.

Figure 10:
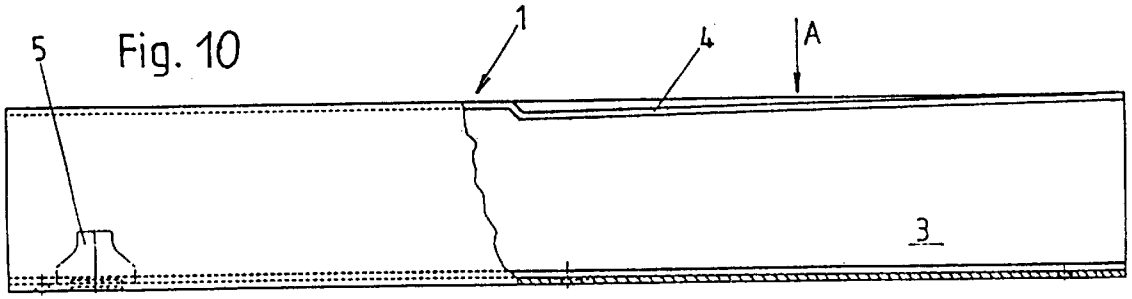
FIG. 10 shows a side view of the carcass rail of a second embodiment of a pull-out device according to the present invention.
Figure 11:
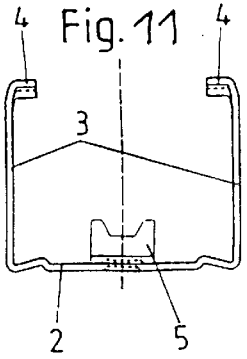
FIG. 11 shows an end view of the carcass rail shown in FIG. 10.
Figure 12:
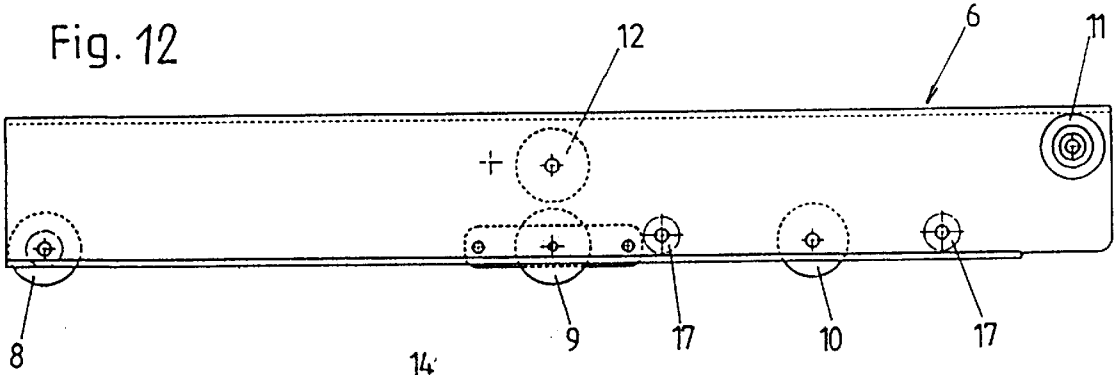
FIG. 12 shows a side view of the intermediate rail of the second embodiment of a pull-out device according to the present invention.
Figure 13:
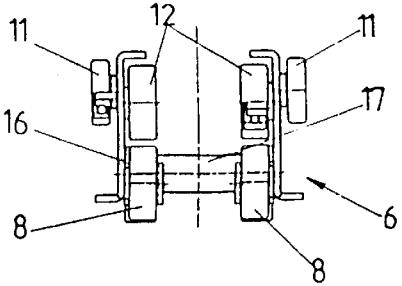
FIG. 13 shows an end view of the intermediate rail shown in FIG. 12.
Figure 14:
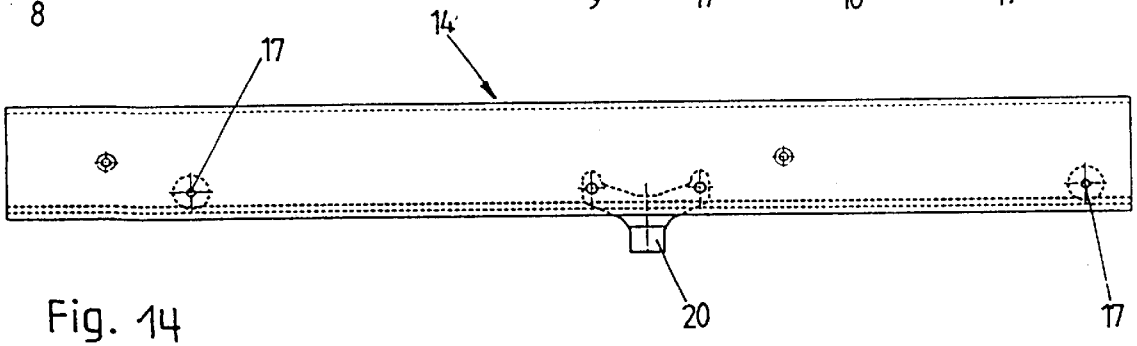
FIG. 14 shows a side view of the pull-out rail of the second embodiment of a pull-out device according to the present invention.
Figure 15:
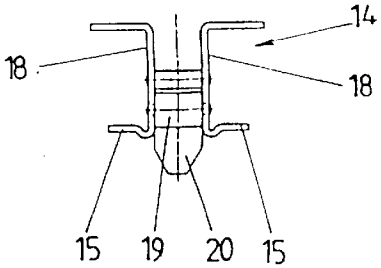
FIG. 15 shows an end view of the pull-out rail shown in FIG. 5.

In the embodiment shown in FIGS. 10 and 16*a*–16*b,* the inclination of the running track for the support roller 11 remains uniform during pulling of the rails. However, the deformation can be effected in such a way that inclination starts only at a point at which the support roller 11 has already been displaced along a half of its rolling path. In FIG. 10, this point or region is designated with a letter A. The inclination of the running track toward the front end starts at the point or region A. The length of the region A can vary. As a result of this, first, the rails are displaced parallel to each other and are lifted only at the easel portion of their displacement path.

In both embodiments, the U-shaped rails are telescopically displaced within each other, with their open sides facing upward. However, the present invention is also applicable to such pull-out devices in which the U-shaped rails have their open sides facing downward. In the later devices, the edge-side flanges of the U-shaped profile of rollers 8–10 are removed.

Though the present invention was shown and described with references to the preferred embodiments, various modifications thereof will be apparent to those skilled in the art and, therefore, it is not intended that the invention be limited to the disclosed embodiment or details thereof, and departure can be made therefrom within the spirit and scope of the appended claims.

What is claimed is:

1. A pull-out device for a tall cupboard, comprising:

a U-shaped carcass rail having opposite cheeks provided at upper edges thereof with inwardly bent flanges which serve as running tracks;

an intermediate rail received in the carcass rail and having opposite cheeks and a plurality of support and running rollers having axles thereof lying in different horizontal planes, with one support roller of the plurality of support rollers being provided in an upper rear portion of each cheek of the intermediate rail and displaceable along the running track defined by a respective flange of the carcass rail, and with at least one running roller of a plurality of running rollers being provided in a middle region of a longitudinal extent of each cheek of the intermediate rail and supported with a radial clearance; and a pull-out rail having opposite horizontal flanges supported by the running rollers, wherein the flanges of the carcass rail which serve as running tracks, are inclined, from a rear end of the carcass rail, at least along a portion of their longitudinal extent toward a front end of the carcass rail.

2. A pull-out device as set forth in claim 1, wherein the flanges of the carcass rail, which serve as running tracks, are inclined at least along a portion of a longitudinal extent of a path, which is overrun by a respective support roller upon the pull-out rail being pulled out, from the rear end toward the front end, with an inclination being formed by appropriate stamping.

3. A pull-out device as set forth in claim 1, wherein the inclination angle of the flanges of the carcass rail, which serve as running tracks, is equal to several degrees.

4. A pull-out device as set forth in claim 1, wherein the longitudinal edges of the carcass rail extend parallel to each other.

5. A pull-out device as set forth in claim 1, wherein an inclination angle equal to several degrees.

6. A pull-out device according to claim 1, wherein the inclination is formed relative to a horizontal rectilinear web which connects the cheeks of the carcass rail.

* * * * *